US006651597B2

(12) United States Patent
Daniel et al.

(10) Patent No.: US 6,651,597 B2
(45) Date of Patent: Nov. 25, 2003

(54) PLASMATRON HAVING AN AIR JACKET AND METHOD FOR OPERATING THE SAME

(75) Inventors: Michael J. Daniel, Indianapolis, IN (US); Rudolf M. Smaling, Concord, MA (US); Kurt D. Zwanzig, Columbus, IN (US); M. Lee Murrah, Bloomfield, MI (US); Shawn D. Bauer, Indianapolis, IN (US)

(73) Assignee: Arvin Technologies, Inc., Troy, MI (US)

( * ) Notice: Subject to any disclaimer, the term of this patent is extended or adjusted under 35 U.S.C. 154(b) by 0 days.

(21) Appl. No.: 10/131,169

(22) Filed: Apr. 23, 2002

(65) Prior Publication Data

US 2003/0196611 A1 Oct. 23, 2003

(51) Int. Cl.[7] ..... F02B 43/08
(52) U.S. Cl. ..... 123/3
(58) Field of Search ..... 123/3, 1 A, DIG. 12

(56) References Cited

U.S. PATENT DOCUMENTS

| | | | | |
|---|---|---|---|---|
| 3,955,941 | A * | 5/1976 | Houseman et al. | 48/95 |
| 4,645,521 | A | 2/1987 | Freesh | |

(List continued on next page.)

FOREIGN PATENT DOCUMENTS

| | | | |
|---|---|---|---|
| DE | 237120 | A1 | 6/1924 |
| DE | 30 48 540 | | 7/1982 |
| DE | 237120 | A1 | 7/1986 |
| DE | 195 10 804 | | 9/1996 |
| DE | 19644864 | A1 | 5/1998 |
| DE | 19644864 | | 5/1998 |
| DE | 197 57 936 | | 7/1999 |
| DE | 19927518 | | 1/2001 |
| EP | 0096538 | | 12/1983 |
| EP | 0153116 | | 8/1985 |
| EP | 0485922 | A1 | 5/1992 |
| EP | 1030395 | | 8/2000 |
| EP | 1057998 | | 12/2000 |
| FR | 2593493 | | 7/1987 |
| FR | 2620436 | | 3/1989 |
| GB | 355210 | | 2/1930 |
| GB | 1221317 | | 2/1971 |
| GB | 2241746 | | 9/1991 |
| JP | 51 27630 | | 3/1976 |
| JP | 51 27630 | | 8/1976 |
| JP | 02 121300 | | 5/1990 |
| JP | 03195305 | | 8/1991 |
| JP | 05 231242 | | 9/1993 |
| JP | 07 292372 | | 11/1995 |
| SU | 1519762 | | 11/1989 |
| WO | WO 85/00159 | | 1/1985 |
| WO | WO 94/03263 | | 2/1994 |
| WO | WO 95/06194 | | 3/1995 |
| WO | WO 96/24441 | | 8/1996 |
| WO | WO 98/45582 | | 10/1998 |
| WO | WO 00/26518 | | 5/2000 |
| WO | WO 01/14698 | A1 | 3/2001 |
| WO | WO 01/14702 | A1 | 3/2001 |
| WO | WO 01/33056 | A1 | 5/2001 |

OTHER PUBLICATIONS

Jahn, "Physics of Electric Propulsion", pp. 126–130 (1986).
Belogub et al., "Petrol–Hydrogen Truck With Load–Carrying Capacity 5 Tons", Int. J. Hydrogen Energy, vol. 16, No. 6, pp. 423–426 (1991).

(List continued on next page.)

*Primary Examiner*—Henry C. Yuen
*Assistant Examiner*—Hyder Ali
(74) *Attorney, Agent, or Firm*—Barnes & Thornburg

(57) ABSTRACT

A plasmatron reforms hydrocarbon fuels so as to produce a reformed gas which is supplied to a remote device such as an internal combustion engine or a fuel cell. The plasmatron includes an air jacket which removes heat from the reaction chamber of the plasmatron and supplies heated air to the plasma-generating assembly of the plasmatron. A method of operating a plasmatron is also disclosed.

18 Claims, 2 Drawing Sheets

U.S. PATENT DOCUMENTS

| | | | | |
|---|---|---|---|---|
| 5,143,025 | A | | 9/1992 | Munday |
| 5,159,900 | A | | 11/1992 | Damman |
| 5,205,912 | A | | 4/1993 | Murphy |
| 5,207,185 | A | | 5/1993 | Greiner et al. |
| 5,212,431 | A | | 5/1993 | Origuchi et al. |
| 5,228,529 | A | | 7/1993 | Rosner |
| 5,272,871 | A | | 12/1993 | Oshima et al. |
| 5,284,503 | A | | 2/1994 | Bitler et al. |
| 5,293,743 | A | | 3/1994 | Usleman et al. |
| 5,317,996 | A | | 6/1994 | Lansing |
| 5,362,939 | A | | 11/1994 | Hanus et al. |
| 5,409,784 | A | | 4/1995 | Bromberg et al. |
| 5,409,785 | A | | 4/1995 | Nakano et al. |
| 5,412,946 | A | | 5/1995 | Oshima et al. |
| 5,425,332 | A | | 6/1995 | Rabinovich et al. |
| 5,437,250 | A | | 8/1995 | Rabinovich et al. |
| 5,441,401 | A | | 8/1995 | Yamaguro et al. |
| 5,445,841 | A | | 8/1995 | Arendt et al. |
| 5,451,740 | A | | 9/1995 | Hanus et al. |
| 5,560,890 | A | | 10/1996 | Berman et al. |
| 5,599,758 | A | | 2/1997 | Guth et al. |
| 5,660,602 | A | | 8/1997 | Collier, Jr. et al. |
| 5,666,923 | A | | 9/1997 | Collier, Jr. et al. |
| 5,787,864 | A | | 8/1998 | Collier, Jr. et al. |
| 5,813,222 | A | | 9/1998 | Appleby |
| 5,826,548 | A | | 10/1998 | Richardson, Jr. |
| 5,845,485 | A | | 12/1998 | Murphy et al. |
| 5,847,353 | A | | 12/1998 | Titus et al. |
| 5,852,927 | A | * | 12/1998 | Cohn et al. ..... 60/780 |
| 5,887,554 | A | | 3/1999 | Cohn et al. |
| 5,894,725 | A | | 4/1999 | Cullen et al. |
| 5,910,097 | A | | 6/1999 | Boegner et al. |
| 5,921,076 | A | | 7/1999 | Krutzsch et al. |
| 5,974,791 | A | | 11/1999 | Hirota et al. |
| 6,012,326 | A | | 1/2000 | Raybone et al. |
| 6,014,593 | A | | 1/2000 | Grufman |
| 6,047,543 | A | | 4/2000 | Caren et al. |
| 6,048,500 | A | | 4/2000 | Caren et al. |
| 6,082,102 | A | | 7/2000 | Wissler et al. |
| 6,122,909 | A | | 9/2000 | Murphy et al. |
| 6,125,629 | A | | 10/2000 | Patchett |
| 6,130,260 | A | | 10/2000 | Hall et al. |
| 6,134,882 | A | | 10/2000 | Huynh et al. |
| 6,152,118 | A | | 11/2000 | Sasaki et al. |
| 6,176,078 | B1 | | 1/2001 | Balko et al. |
| 6,235,254 | B1 | | 5/2001 | Murphy et al. |
| 6,248,684 | B1 | | 6/2001 | Yavuz et al. |
| 6,284,157 | B1 | | 9/2001 | Eliasson et al. |
| 6,311,232 | B1 | | 10/2001 | Cagle et al. |
| 6,322,757 | B1 | | 11/2001 | Cohn et al. |

OTHER PUBLICATIONS

Breshears et al., "Partial Hydrogen Injection Into Internal Combustion Engines", Proceedings of the EPA 1st Symposium on Low Pollution Power Systems and Development, Ann Arbor, Mi, pp. 268–277 (Oct. 1973).

Chuvelliov et al., "Comparison of Alternative Energy Technologies Utilizing Fossil Fuels and Hydrogen Based on Their Damage to Population and Environment in the USSR and East Europe", pp. 269–300.

Correa, "Lean Premixed Combusion for Gas–Turbines: Review and Required Research", PD–vol. 33, Fossile Fuel Combustion, ASME, pp. 1–9 (1991).

Czernichowski et al., "Multi–Electrodes High Pressure Gliding Discharge Reactor and its Application for Some Waste Gas and Vapor Incineration", Proceedings of Workshop on Plasma Destruction of Wastes, France, pp. 1–13 (1990).

Das, "Exhaust Emission Characterization of Hydrogen–Operated Engine System: Nature of Pollutants and their Control Techniques", Int. J. Hyrdrogen, vol. 11, pp. 765–775 (1991).

Das, "Hydrogen Engines: A View of the Past and a Look into the Future", Int. J. of Hydrogen Energy, vol. 15, No. 6, pp. 425–443 (1990).

Das, "Fuel Induction Techniques for a Hydrogen Operated Engine", Int. J. of Hydrogen Energy, vol. 15, No. 11 (1990).

DeLuchi, "Hydrogen Vehicles: An Evaluation of Fuel Storage, Performance, Safety, Environmental Implants and Costs", Int. J. Hydrogen Energy, vol. 14, No. 2, pp. 81–130 (1989).

Duclos et al., "Diagnostic Studies of a Pinch Plasma Accelerator", AIAA Journal, vol. 1, No. 11, pp. 2505–2513 (Nov. 1963).

Feucht et al., "Hydrogen Drive for Road Vehicles—Results from the Fleet Test Run in Berlin", Int. J. Hydrogen Energy, vol. 13, No. 4, pp. 243–250 (1998).

Finegold et al., "Dissociated Methanol as a Consumable Hydride for Automobiles and Gas Turbines", pp. 1359–1369, Advances in Hydrogen Energy 3 (Jun. 13–17, 1982.

Hall et al., "Initial Studies of a New Type of Ignitor: The Railplug",—SAE Paper 912319, pp. 1730–1746 (1991).

Houseman et al., "Hydrogen Engines Based On Liquid Fuels, A Review", G.E., Proc., 3rd World Hydrogen Energy Conf., pp. 949–968 (1980).

Houseman et al., "Two Stage Combustion for Low Emission Without Catalytic Converters", Proc. of Automobile Engineering Meeting, Dearborn, Mi., pp. 1–9 (Oct. 18–22, 1976).

Jones, et al., "Exhaust Gas Reforming of Hydrocarbon Fuels", Soc. of Automotive Engineers, Paper 931086, pp. 223–234 (1993).

Kaske et al., "Hydrogen Production by the Hüls Plasma–Reforming Process", Proc. VI World Hydrogen Energy Conference, vol. 1, pp. 185–190 (1986).

MacDonald, "Evaluation of Hydrogen–Supplemented Fuel Concept with an Experimental Multi–Cylinder Engine", Society of Automotive Engineers, Paper 760101, pp. 1–16 (1976).

Mackay, "Development of a 24 kW Gas Turbine–Driven Generator Set for Hybrid Vehicles", 940510, pp. 99–105, NoMac Energy Systems, Inc.

Mackay, "Hybrid Vehicle Gas Turbines", 930044, pp. 35–41, NoMac Energy Systems, Inc.

Mathews et al., "Further Analysis of Railplugs as a New Type of Ignitor", SAE Paper 922167, pp. 1851–1862 (1992).

Mischenko et al., "Hydrogen as a Fuel for Road Vehicles", Proc. VII World Hydrogen Energy Conference, vol. 3, pp. 2037–2056 (1988).

Monroe et al., "Evaluation of a Cu/Zeolite Catalyst to Remove $NO_x$ from Lean Exhaust", Society of Automotive Engineers, Paper 930737, pp. 195–203 (1993).

Rabinovich et al., "On Board Plasmatron Generation of Hydrogen Rich Gas for Engine Pollution Reduction", Proceedings of NIST Workshop on Advanced Components for Electric and Hybrid Electric Vehicles, Gaithersburg, MD, pp. 83–88 (Oct. 1993) (not published).

Rabinovich et al., "Plasmatron Internal Combustion Engine System for Vehicle Pollution Reduction", Int. J. of Vehicle Design, vol. 15, Nos. 3/4/5, pp. 234–242 (1984).

Scott et al., "Hydrogen Fuel Breakthrough with On–Demand Gas Generator", 372 Automotive Engineering, vol. 93, No. 8, Warrendale, PA, U.S.A., pp. 81–84 (Aug. 1985).

Shabalina et al., "Slag Cleaning by Use of Plasma Heating", pp. 1–7.
Handbook of Thermodynamic High Temperature Process Data, pp. 507–547.
Varde et al., "Reduction of Soot in Diesel Combustion with Hydrogen and Different H/C Gaseous Fuels", Hydrogen Energy Progress V, pp. 1631–1639.
Wang et al., "Emission Control Cost Effectiveness of Alternative–Fuel Vehicles", Society of Automotive Engineers, Paper 931786, pp. 91–122 (1993).
Wilson, "Turbine Cars", Technology Review, pp. 50–56 (Feb./Mar., 1995).
Kirwan, "Fast Start–Up On–Board Gasoline Reformer for Near Zero Emissions in Spark–Ignition Engines", Society of Automotive Engineers World Congress, Detroit, MI (Mar. 4–7, 2002), Paper No. 2002–01–1011.
Kirwan, "Development of a Fast Start–up O Gasoline Reformer for Near Zero Spark–Ignition Engines", Delphi Automotive Systems, pp. 1–21 (2002).
Chandler, "Device May Spark Clean–Running Cars", The Boston Globe, p. E1 (Jul. 12, 1999).
Simanaitis, "Whither the Automobile?", Road and Track, pp. 98–102 (Sep. 2001).
Shelef, "Twenty–five Years after Introduction of Automotive Catalysts: What Next?" Journal of Catalysis Today 62, pp. 35–50 (2000).
Stokes, "A Gasoline Engine Concept for Improved Fuel Economy—The Lean Boost System", International Falls Fuels and Lubricants Meeting and Exposition, Baltimore, MD, SAE Technical Paper Series, 14 pp. (Oct. 16–19, 2000).
Tachtler, "Fuel Cell Auxiliary Power Unit—Innovation for the Electric Supply of Passenger Cars?", Society of Automotive Engineers, Paper No. 2000–01–0374, pp. 109–117 (2000).
Bromberg, "Experimental Evaluation of SI Engine Operation Supplemented by Hydrogen Rich Gas from a Compact Plasma Boosted Reformer", Massachusetts Institute of Technology Plasma Science and Fusion Center Report, JA–99–32 (1999).
Bromberg, "Compact Plasmatron–Boosted Hydrogen Gemeration Technology for Vehicular Applications", Int. J. of Hydrogen Energy 24, pp 341–350 (1999).
Bromberg, "Emissions Reductions Using Hydrogen from Plasmatron Fuel Converters", Int. J. of Hydrogen Energy 26, pp. 1115–1121 (2001).
Burch, "An Investigation of the $NO/H_2/O_2$ Reaction on Noble–Metal Catalysts at Low Temperatures Under Lean–Burn Conditions," Journal of Applied Catalysis B: Environmental 23, pp. 115–121 (1999).
Costa, "An Investigation of the $NO/H_2/O_2$ (Lean De–$No_x$) Reaction on a Highly Active and Selective $Pt/La_{0.7}Sr_{0.2}Ce_{0.1}FeO_3$ Catalyst at Low Temperatures", Journal of Catalysis 209, pp. 456–471 (2002).
Frank, "Kinetics and Mechanism of the Reduction of Nitric Oxides by $H_2$ Under Lean–Burn Conditions on a Pt–Mo–Co/$\alpha$–$A1_2O_3$ Catalyst", Journal of Applied Catalysis B: Environmental 19, pp. 45–57 (1998).
Gore, "Hydrogen A Go–Go", Discover, p. 92–93, (Jul., 1999).
Koebel, "Selective Catalytic Reduction of NO and $NO_2$ at Low Temperatures", Journal of Catalysis Today 73, pp. 239–247 (2002).
Nanba, "Product Analysis of Selective Catalytic Reduction of $NO_2$ with $C_2H_4$ Over H–Ferrierite", Journal of Catalysis 211, pp. 53–63 (2002).

* cited by examiner

PLASMATRON HAVING AN AIR JACKET AND METHOD FOR OPERATING THE SAME

BACKGROUND

The present disclosure relates generally to a fuel reformer, and more particularly to a plasmatron having an air jacket and method for operating the same.

Hydrogen has been used as a fuel or fuel additive for an internal combustion engine in an effort to reduce emissions from the engine. One manner of producing hydrogen for use with an internal combustion is by the operation of a plasmatron. A plasmatron reforms hydrocarbon fuel into a reformed gas such as hydrogen-rich gas. Specifically, a plasmatron heats an electrically conducting gas either by an arc discharge or by a high frequency inductive or microwave discharge. The internal combustion engine combusts the hydrogen-rich gas from the plasmatron either as the sole source of fuel, or in conjunction with hydrocarbon fuels.

A plasmatron may also be utilized to supply hydrogen-rich gas to devices other than internal combustion engines. For example, hydrogen-rich gas reformed by a plasmatron may be supplied to a fuel cell for use by the fuel cell in the production of electrical energy.

Systems including plasmatrons are disclosed in U.S. Pat. No. 5,425,332 issued to Rabinovich et al.; U.S. Pat. No. 5,437,250 issued to Rabinovich et al.; U.S. Pat. No. 5,409,784 issued to Brumberg et al.; and U.S. Pat. No. 5,887,554 issued to Cohn, et al., the disclosures of each of which is hereby incorporated by reference.

SUMMARY

According to one aspect of the disclosure, there is provided a plasmatron. The plasmatron reforms hydrocarbon fuels so as to produce a reformed gas which is supplied to an external device such as an internal combustion engine or a fuel cell. The plasmatron includes an air jacket which removes heat from the reaction chamber of the plasmatron and supplies heated air to the plasma-generating assembly of the plasmatron.

A method of operating a plasmatron is also disclosed herein. The method includes the step of reforming a fuel in a reaction chamber defined in a plasmatron housing so as to produce a reformed gas. The method also includes the step of advancing air through a jacket and into the reaction chamber. The jacket is positioned around a portion of the periphery of the housing.

According to another aspect of the disclosure, there is provided an apparatus for reforming hydrocarbon fuel into a reformed gas. The apparatus includes a housing having a reaction chamber defined therein and a jacket having an air chamber defined therein. The jacket is positioned around a portion of the periphery of the housing. The air chamber is in fluid communication with the reaction chamber.

The above and other features of the present disclosure will become apparent from the following description and the attached drawings.

BRIEF DESCRIPTION OF THE DRAWINGS

The detailed description particularly refers to the accompanying figures in which.

DETAILED DESCRIPTION OF THE DRAWINGS

Figure 1:
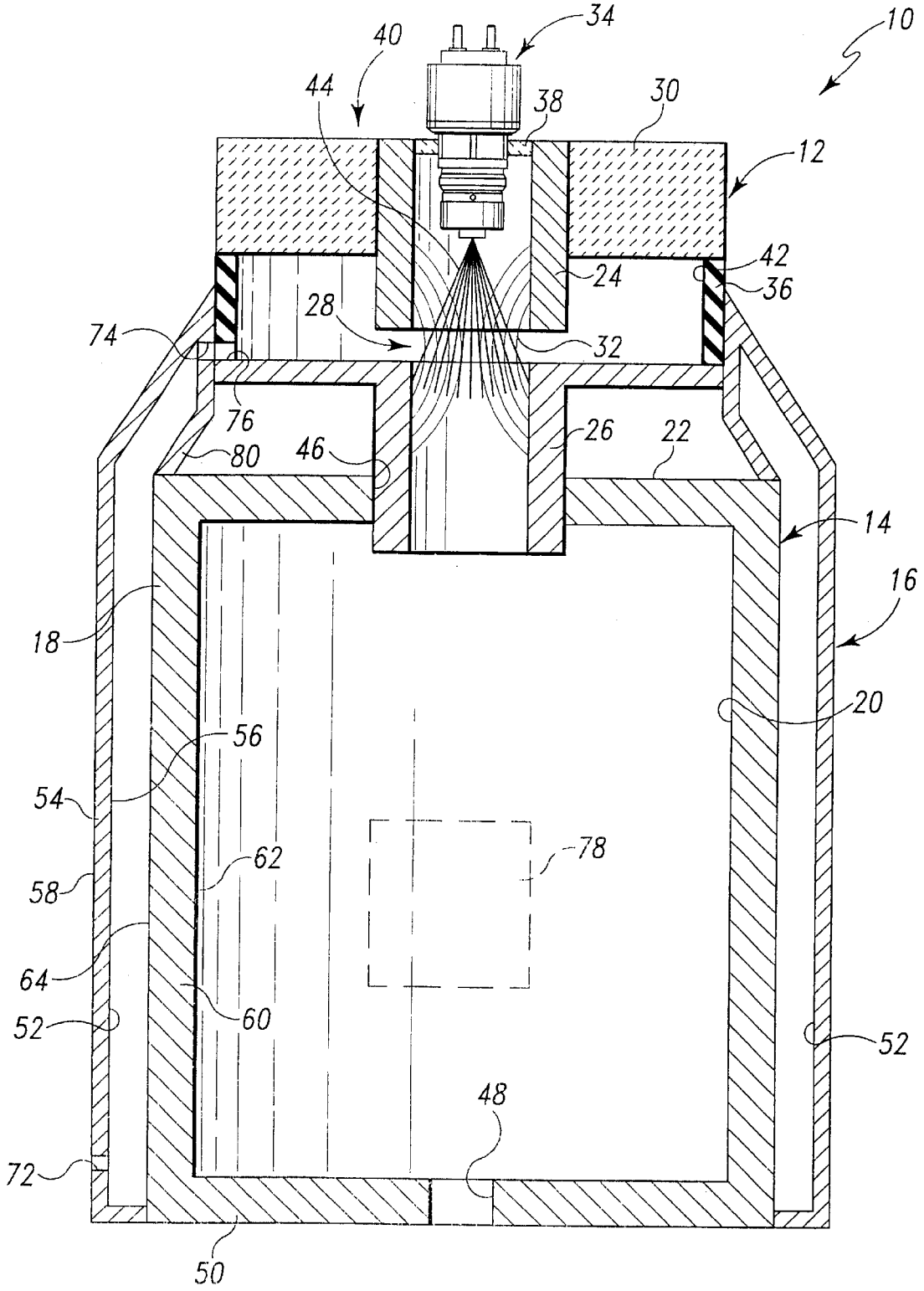
FIG. 1 is a cross sectional view of a first embodiment of a plasmatron, note that the fuel injector is not shown in cross section for clarity of description.
Figure 2:
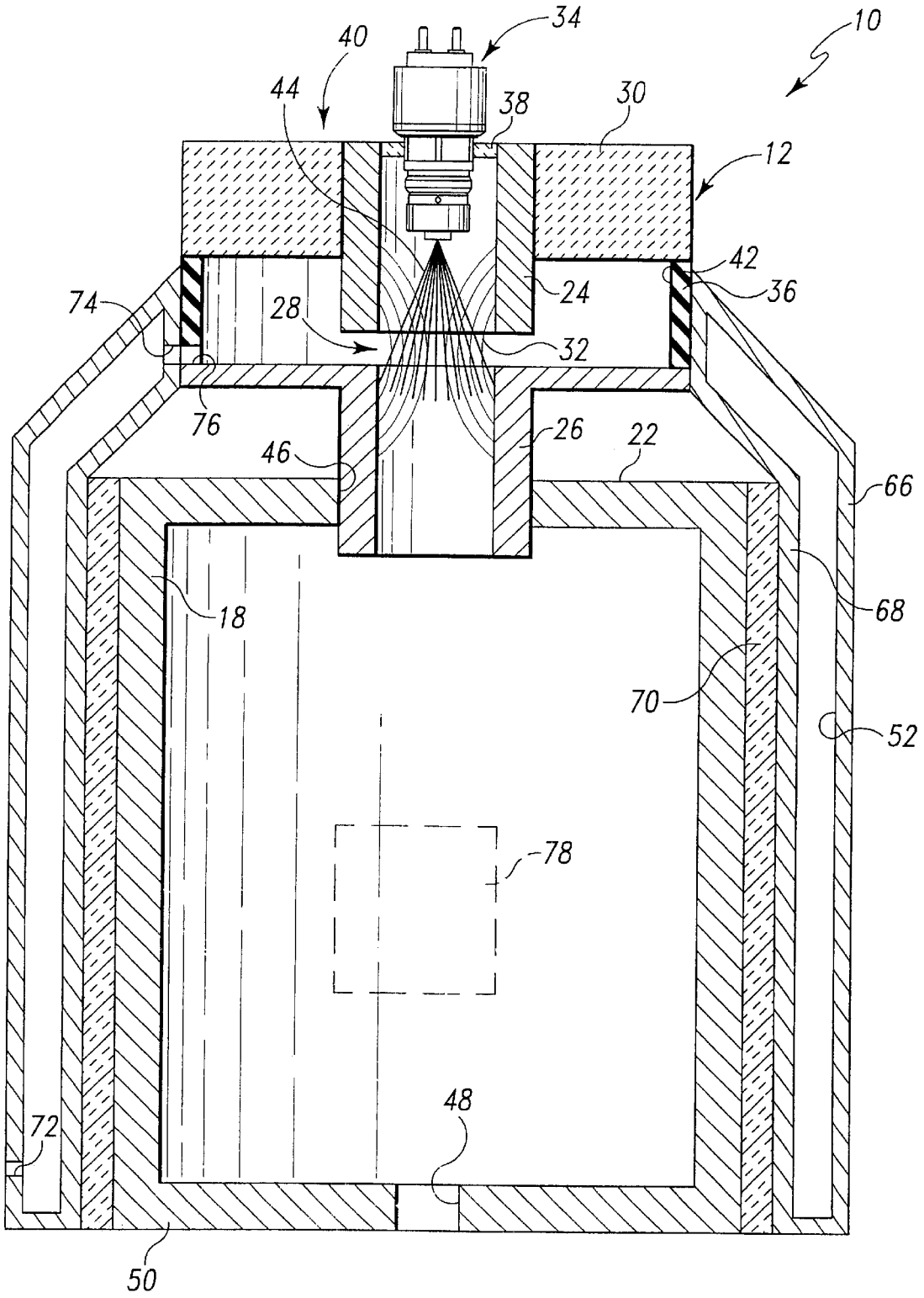
FIG. 2 is a view similar to FIG. 1, but showing a second embodiment of a plasmatron.

Referring now to FIGS. 1 and 2, there is shown a fuel reformer. The fuel reformer is embodied as a plasmatron 10 which uses a plasma—an electrically heated gas—to convert hydrocarbon fuel into a reformed gas such as a hydrogen-rich gas.

Hydrogen-rich gas generated by the plasmatron 10 may be supplied to an internal combustion engine (not shown) such as a diesel engine or spark-ignition gasoline engine. In such a case, the internal combustion engine combusts the reformed gas as either the sole source of fuel, or alternatively, as a fuel additive to a hydrocarbon fuel. Alternatively, hydrogen-rich gas generated by the plasmatron 10 may be supplied to a fuel cell (not shown) such as an alkaline fuel cell (AFC), a phosphoric acid fuel cell (PAFC), a proton exchange membrane fuel cell (PEMFC), a solid oxide fuel cell (SOFC), a molten carbonate fuel cell (MCFC), or any other type of fuel cell. In such a case, the fuel cell utilizes the hydrogen-rich gas in the production of electrical energy.

The plasmatron 10 includes a plasma-generating assembly 12, a reactor 14, and an air jacket 16. As shown in FIG. 1, the reactor 14 includes a reactor housing 18 having a reaction chamber 20 defined therein. The plasma-generating assembly 12 is secured to an upper portion 22 of the reactor housing 18. Specifically, the plasma-generating assembly 12 includes an upper electrode 24 and a lower electrode 26. The electrodes 24, 26 are spaced apart from one another so as to define an electrode gap 28 therebetween. An insulator 30 electrically insulates the electrodes from one another. Collectively, portions of the electrodes 24, 26, the insulator 30, a gasket 36, and a cap 38 define a plasma housing 40.

The electrodes 24, 26 are electrically coupled to an electrical power supply (not shown) such that, when energized, a plasma arc 32 is created across the electrode gap 28 (i.e., between the electrodes 24, 26). A fuel input mechanism such as fuel injector 34 injects a hydrocarbon fuel 44 into the plasma arc 32. The fuel injector 34 may be any type of fuel injection mechanism which produces a desired mixture of fuel and air and thereafter injects such a mixture into the plasma housing 40. In certain configurations, it may be desirable to atomize the fuel mixture prior to, or during, injection of the mixture into the plasma housing 40. Such fuel injector assemblies (i.e., injectors which atomize the fuel mixture) are commercially available.

As shown in FIG. 1, the configuration of the plasma housing 40 defines an annular air chamber 42. Pressurized air in the air chamber 42 is directed radially inwardly through the electrode gap 28 so as to "bend" the plasma arc 32 inwardly. Such bending of the plasma arc 32 ensures that the injected fuel 44 is directed through the plasma arc 32. Such bending of the plasma arc 32 also reduces erosion of the electrodes 22, 24.

As shown in FIG. 1, the lower electrode 24 extends downwardly through an air inlet 46 defined in the reactor housing 18. As such, reformed gas (or partially reformed gas) exiting the plasma arc 32 is advanced into the reaction chamber 20. One or more catalysts 78 are positioned in reaction chamber 20. The catalysts 78 complete the fuel reforming process, or otherwise treat the reformed gas, prior to exit of the reformed gas through a gas outlet 48.

The aforedescribed configuration of the plasmatron 10 is exemplary in nature, with numerous other configurations of plasmatron being contemplated for use in regard to the present disclosure. Specifically, the herein described air jacket 16 (including features thereof) is contemplated for use in regard to any particular design of a plasmatron.

The air jacket 16 envelops the reactor 14. Specifically, the air jacket 16 is positioned around a portion of the periphery of the reactor housing 18. It should be appreciated that the configuration of the air jacket 16 depicted in FIGS. 1 and 2 is exemplary in nature and that other configurations of the air jacket 16 are contemplated for use. For example, the lower portion of the jacket 16 may be extended downwardly (as viewed in the orientation of FIGS. 1 and 2) so as to also envelop the lower portion 50 of the reactor housing 18. The jacket 16 may also be extended upwardly (as viewed in the orientation of FIGS. 1 and 2) to envelop a larger portion of the plasma-generating assembly 12. The jacket 16 may also be configured to more closely or less closely "conform" to the outer shape of the reactor housing 18 or the components of the plasma-generating assembly 12.

The air jacket 16 has an air chamber 52 defined therein. In the case of the air jacket 16 depicted in FIG. 1, structures of the air jacket 16, along with certain structures of the reactor housing 18, cooperate to define the air chamber 52. Specifically, the air jacket 16 has a side wall 54 which has an inner wall surface 56 and an outer wall surface 58. Similarly, a side wall 60 associated with the reactor housing 18 has an inner wall surface 62 and an outer wall surface 64. As such, the air chamber 52 is defined by the area between the outer wall surface 64 of the reactor side wall 60 and the inner wall surface 56 of the jacket side wall 54. In such a configuration, a short wall extension 80 may be utilized to "bridge" the distance between the upper edge of the reactor housing 18 and the plasma housing 40.

Alternatively, as shown in FIG. 2, the jacket 16 may be configured with both an inner wall and an outer wall such that the air chamber 52 is defined entirely by structures associated with the jacket 16. Specifically, the air jacket 16 may include an outer jacket wall 66 and an inner jacket wall 68. The air chamber 52 is defined by the area between the two walls 66, 68. Such a configuration of the air jacket 16 (i.e., use of two walls as opposed to one) is particularly useful in the design of certain configurations of the plasmatron 10. For example, as shown in FIG. 2, it may be desirable to utilize an air jacket 16 constructed with both an inner and outer side wall when the design of the plasmatron include a sleeve of thermal insulation 70 interposed between the reactor housing 18 and the air jacket 16.

In either configuration of the air jacket 16, air is advanced through the jacket 16 and into the annular air chamber 42 of the plasma housing 40, and ultimately into the reaction chamber 20. Specifically, the air jacket 16 includes one or more air inlets 72 and one or more air outlets 74. The inlets 72 and the outlets 74 may be configured as orifices which are defined in the walls of the jacket 16, or, alternatively, may include a tube, coupling assembly, or other structure which extends through the wall of the jacket 16. In any case, air, typically pressurized air, is advanced through the air inlets 72, through the air chamber 52 of the jacket 16, through the outlets 74 of the air jacket 16, into an air inlet 76 of the plasma housing 40, and into the annular air chamber 42. As described above, pressurized air in the annular air chamber 42 is directed radially inwardly through the electrode gap 28 so as to "bend" the plasma arc 32 inwardly thereby ensuring that the injected fuel 44 is directed through the plasma arc 32. From there, the pressurized air, along with the reformed gas (or partially reformed gas), is directed through the air inlet 46 of the reactor housing 18, and into the reaction chamber 20 such that the gas may be further treated by the catalysts 78 prior to exhaust of the reformed gas through the gas outlet 48.

It should be appreciated that air is heated during advancement thereof through the jacket 16. Specifically, the reactions in the reactor chamber 20 are exothermic in nature. As such, heat generated by the reactions in the reactor chamber 20 is transferred to the air advancing through the air chamber 52 of the jacket 16 via a thermal path which includes the side wall 60 of the reactor housing 18 (in the case of the plasmatron of FIG. 1), or a thermal path which includes the side wall 60 of the reactor housing 18, the sleeve of thermal insulation 70, and the inner jacket wall 68 of the air jacket 16 (in the case of the plasmatron 10 of FIG. 2).

Such removal of heat from the reaction chamber 20 is particularly useful in certain applications of the plasmatron 10 in which it is desirable to cool the reformed gas prior to delivery thereof to another device (e.g., an internal combustion engine or a fuel cell). Moreover, in certain configurations, it may be desirable to maintain a certain temperature within the reactor chamber 20 in order to enhance the efficiency of the catalytic reactions being performed therein. In such a case, the thickness and material type of the sleeve of thermal insulation 70 may be varied in order to maintain a desired temperature within the reaction chamber 20, with any residual heat transferred from the thermal insulation 70 to the air advancing through the air jacket 16.

Moreover, heating the air advancing through the air jacket 16 also enhances the plasma generation process of the plasma-generating assembly 12. Specifically, the plasma reforming process of the plasmatron 10 is enhanced as a result of the generation of a relatively hot plasma (e.g., 1,000°–3,000° C.). As such, the introduction of heated air into the plasma process facilitates the creation and maintenance of a hot plasma. Hence, by heating air in the air jacket 16 prior to the introduction thereof into the plasma process, heat for facilitating the creation of the high temperatures associated with the plasma process may be created without having to utilize an additional heating device such as heat exchangers which are distinct from the plasmatron 10. This enhances the overall operating efficiency and lowers the cost of the system (e.g., engine or fuel cell system) into which the plasmatron 10 is integrated.

In operation, the plasmatron 10 is operated to reform a hydrocarbon fuel into a reformed gas such as hydrogen-rich gas. To do so; a fuel 44 is injected into a plasma arc 32 which alone, or in concert with one or more catalysts 78, reforms the fuel into the reformed gas which is then exhausted or otherwise advanced through a gas outlet 48 and thereafter supplied to an external device such as an internal combustion engine or a fuel cell.

Heated air is utilized during the above-described reforming process. Specifically, air is advanced through the air inlets 72 of the air jacket 16 and into the air chamber 52. Once inside the air chamber 52, heat is transferred from the reactor chamber 20 to the air as it is advanced through the chamber 52. The heated air is then advanced out the air outlets 74 of the jacket 16, through the air inlet 76 of the plasma housing 40, and into the annular air chamber 42. Air is then directed through the electrode gap 28, impinged upon the plasma arc 32, and then advanced, along with reformed gas (or partially reformed gas) through the inlet 46 of the reactor housing 18 and into the reaction chamber 20.

While the disclosure is susceptible to various modifications and alternative forms, specific exemplary embodiments thereof have been shown by way of example in the drawings and has herein be described in detail. It should be understood, however, that there is no intent to limit the disclosure to the particular forms disclosed, but on the contrary, the intention is to cover all modifications, equivalents, and alternatives falling within the spirit and scope of the disclosure.

There are a plurality of advantages of the present disclosure arising from the various features of the apparatus and methods described herein. It will be noted that alternative embodiments of the apparatus and methods of the present disclosure may not include all of the features described yet still benefit from at least some of the advantages of such features. Those of ordinary skill in the art may readily devise their own implementations of an apparatus and method that incorporate one or more of the features of the present disclosure and fall within the spirit and scope of the present disclosure.

For example, additional layers of thermal insulation may be utilized. Specifically, a sleeve of thermal insulation may be positioned around the air jacket 16 of the plasmatron 10 of FIGS. 1 and 2.

What is claimed is:

1. A plasmatron, comprising:

a first electrode and a second electrode. said first electrode being spaced apart from said second electrode so as to define an electrode gap:

a housing having a reaction chamber defined therein, said housing having a chamber air inlet; and a jacket positioned around a portion of the periphery of said housing, said jacket defining an air chamber, wherein said air chamber is in fluid communication with said reaction chamber via said chamber air inlet.

2. The plasmatron of claim 1, wherein:

said jacket has a jacket air inlet, and said jacket air inlet is in fluid communication with said reaction chamber via a fluid path which includes said air chamber and said chamber air inlet.

3. The plasmatron of claim 1, further comprising a sleeve of thermal insulation interposed between said housing and said jacket.

4. The plasmatron of claim 1, wherein:

said housing comprises a housing wall having an inner wall surface and an outer wall surface, said jacket comprises a jacket wall having an inner wall surface and an outer wall surface, and said air chamber is defined by an area between said outer wall surface of said housing wall and said inner wall surface of said jacket wall.

5. The plasmatron of claim 1, wherein:

said jacket comprises an inner jacket wall and an outer jacket wall, and said air chamber is defined by an area between said inner jacket wall and said outer jacket wall.

6. The plasmatron of claim 1, wherein:

said housing is configured such that air advanced through said chamber air inlet from said air chamber is directed into said electrode gap.

7. A method of operating a plasmatron, comprising the steps of:

reforming a fuel in a reaction chamber defined in a plasmatron housing so as to produce a reformed gas, said reforming step comprises generating a plasma arc; and advancing air through a jacket and into said reaction chamber, said jacket being positioned around a portion of the periphery of said housing.

8. The method of claim 7, wherein said advancing step comprises heating said air during advancement thereof through said jacket.

9. The method of claim 7, wherein:

said reforming step comprises generating heat in said reaction chamber, and said advancing step comprises transferring a portion of said heat generated in said reaction chamber to said air advancing through said jacket.

10. The method of claim 7, wherein:

said advancing step comprises directing said air from said jacket into said plasma arc.

11. The method of claim 10, wherein:

said reforming step further comprises generating heat in said reaction chamber, and said advancing step further comprises (i) transferring a portion of said heat generated in said reaction chamber to said air advancing through said jacket, (ii) directing said heated air into said plasma arc.

12. The method of claim 7, wherein:

said plasmatron has an upper electrode and a lower electrode positioned in said housing, said upper electrode is spaced apart from said lower electrode so as to define an electrode gap, and said advancing step comprises advancing said air into said electrode gap.

13. An apparatus for reforming hydrocarbon fuel into a reformed gas, comprising:

a first electrode and a second electrode, said first electrode being spaced apart from said second electrode so as to define an electrode gap;

a housing having a reaction chamber defined therein; and a jacket having an air chamber defined therein, wherein (i) said jacket is positioned around a portion of the periphery of said housing, and (ii) said air chamber is in fluid communication with said reaction chamber.

14. The apparatus of claim 13, wherein:

said housing is configured such that air advanced through said jacket is directed into said electrode gap.

15. The apparatus of claim 13, further comprising a sleeve of thermal insulation interposed between said housing and said jacket.

16. The apparatus of claim 13, wherein:

said housing comprises a housing wall having an inner wall surface and an outer wall surface, said jacket comprises a jacket wall having an inner wall surface and an outer wall surface, and said air chamber is defined by an area between said outer wall surface of said housing wall and said inner wall surface of said jacket wall.

17. The apparatus of claim 13, wherein:

said jacket comprises an inner jacket wall and an outer jacket wall, and said air chamber is defined by an area between said inner jacket wall and said outer jacket wall.

18. The apparatus of claim 13, wherein:

said housing has an air inlet and a gas outlet, air from said jacket is advanced into said reaction chamber via said air inlet, and said reformed gas is advanced out of said reaction chamber via said gas outlet.

* * * * *